US006056833A

United States Patent [19]

Asfahani et al.

[11] Patent Number: 6,056,833

[45] Date of Patent: May 2, 2000

[54] THERMOMECHANICALLY CONTROLLED PROCESSED HIGH STRENGTH WEATHERING STEEL WITH LOW YIELD/ TENSILE RATIO

[75] Inventors: Riad Asfahani, Cranberry Township; Samuel J. Manganello, Pittsburgh, both of Pa.

[73] Assignee: USX Corporation, Pittsburgh, Pa.

[21] Appl. No.: 09/118,902

[22] Filed: Jul. 20, 1998

Related U.S. Application Data

[63] Continuation-in-part of application No. 08/899,144, Jul. 23, 1997, abandoned.

[51] Int. Cl.[7] ..... C22C 38/20; C22C 38/24

[52] U.S. Cl. ..... 148/334; 148/335

[58] Field of Search ..... 148/654, 653, 148/334, 335; 420/109, 111

[56] References Cited

FOREIGN PATENT DOCUMENTS

| | | | |
|---|---|---|---|
| 57-143432 | 9/1982 | Japan | 148/654 |
| 58-52423 | 3/1983 | Japan | 148/654 |
| 61-67717 | 4/1986 | Japan | 148/654 |
| 402197522 | 8/1990 | Japan | 148/654 |

*Primary Examiner*—Deborah Yee
*Attorney, Agent, or Firm*—W.F. Riesmeyer, III

[57] ABSTRACT

A high performance weathering steel having a minimum yield strength of 70–75 ksi and a yield/tensile ratio less than about 0.85 is produced from a steel composition consisting essentially, in weight percent, of about: carbon 0.08–0.12%; manganese 0.80–1.35%; silicon 0.30–0.65%; molybdenum 0.08–0.35%; vanadium 0.06–0.14%; copper 0.20–0.40%; nickel 0.50% max.; chromium 0.30–0.70%; phosphorous 0.010–0.020%; columbium up to about 0.04%, titanium up to 0.02%, sulfur up to 0.01%, iron, balance except for incidental impurities; heating the steel to a hot rolling temperature, rolling the steel to a thickness about 2 to 3 times the final desired thickness, air-cooling the steel to a temperature of about 1800–1850° F. (RCR) or about 1600–1650° F. (CCR), recrystallize control rolling or conventionally control rolling the steel with finish rolling at a temperature of about 1700–1750° F. (RCR) or about 1400–1500° F. (CCR), then water-cooling the steel to about 900–1200° F., especially about 1100° F., then air-cooling the steel to ambient temperature, to produce sections up to at least 2 inches thick and a length of 90 feet or more, without further heat treatment.

19 Claims, 2 Drawing Sheets

Magnification = 400X
(Etched in 2 percent Nital)

THERMOMECHANICALLY CONTROLLED PROCESSED HIGH STRENGTH WEATHERING STEEL WITH LOW YIELD/TENSILE RATIO

RELATED APPLICATIONS

This application is a continuation-in-part of application Ser. No. 08/899,144, filed Jul. 23, 1997, now abandoned.

BACKGROUND

1. Field of the Invention

This invention relates to high strength, high performance, weathering plate steels with high yield strength, at least 70 ksi, preferably at least 75 ksi, and low yield strength-to-tensile strength ratio, and particularly, to thermomechanically controlled processing (TMCP) methods of manufacturing plates of such steels in long, e.g. about 90 to 120 foot, sections up to about 2½ inches thick, without heat treatment such as quenching and tempering. Articles so made are especially useful for the fabrication of bridges and other constructional applications.

2. Prior Art

U.S. Pat. No. 2,586,042 discloses a low-alloy, high-yield strength (50 ksi) fabricable steel with superior resistance to atmospheric corrosion in thicknesses to about ½ inch [COR-TEN (later COR-TEN A); a registered trademark of U.S.Steel), ASTM A242], of medium carbon content (0.10–0.20 wt. %) and containing Mn, Ni, Cr, Mo (0.40–0.60 wt. %), V (0.03–0.10 wt. %), B, Si and Cu. A later modification (U.S. Pat. No. 2,858,206)—COR-TEN B (ASTM A588)—containing 0.12 wt. % C, with Mn, Si, Cu, Cr, Mo (0.15–0.45 wt. %), V (0.03–0.078 wt. %), Ti and B, was introduced to fill the need for a 50 ksi yield strength steel in plate thicknesses through about 4 inches. These two steels have been extensively employed in a variety of constructional applications such as railroad cars, bridges and exposed building framework elements.

Further improvements were made to these steels, including a relatively inexpensive steel with a minimum yield strength of 70 ksi, after quenching and tempering, in plate thicknesses to about 4 inches. "Mechanical Properties and Weldability of a 70 Ksi Minimum Yield Strength Steel for Bridge. Applications," (COR-TEN B-QT 70; ASTM A852 or A709 Grade 70W), U.S. Steel Technical Center Bulletin, Apr. 30, 1985. Such steels generally contained about 0.16–0.20 wt. % C, and such thick plates required a minimum preheat and interpass temperature of about 200–400° F.

A recent publication by Nippon Steel Corporation, *Development of High Performance Steels for Structures*, K. Ichise et al., presents an overview of high performance steels and their manufacture, including use of the thermomechanical control processing (TMCP).

Despite the existence of such prior art steels, the need still exists for a steel having a minimum yield strength of 70 ksi with low yield/tensile ratio and producible in long, e.g. 90 foot, sections for, particularly, bridge and ship construction, and without the need for quenching and tempering (facilities for such heat treatments of such long sections do not exist; they are limited to about 50–55 foot lengths). Such long sections are of further advantage in reducing the number of splice welds of shorter sections and thus reduce costs and enhance appearance and performance of the fabricated structure.

SUMMARY OF THE INVENTION

The invention provides a steel having a composition about as follows:

TABLE I

| Element | Weight Percent |
|---|---|
| carbon | 0.08–0.12<br>preferably less than 0.10 |
| manganese | 0.80–1.35 |
| silicon | 0.30–0.65 |
| molybdenum | 0.08–0.35,<br>preferably about 0.13 to 0.30 |
| vanadium | 0.06–0.14 |
| copper | 0.20–0.40 |
| nickel | up to 0.50 |
| chromium | 0.30–0.70<br>particularly about 0.35 to 0.60 |
| columbium | up to about 0.035,<br>preferably about 0.01 to 0.025 |
| titanium | up to 0.02 |
| sulfur | up to 0.01<br>preferably up to 0.005 |
| phosphorous | 0.02 max.<br>preferably 0.01–0.014 |
| nitrogen | 0.001 to 0.014 |
| iron | balance, except for incidental steelmaking impurities, |

which steel is reheated, e.g. at a temperature of about 2150° F., hot rolled, e.g. to a thickness about 2 times the final desired thickness, air-cooled, e.g. to a temperature of about 1800–1850° F., recrystallize control rolled (RCR) with finish rolling at a temperature near or slightly above the recrystallization-stop temperature, usually about 1700–1750° F., or conventional control rolled (CCR) with 1600–1650° F. hold temperature and 1400–1500° F. finish rolling temperature, then water-cooled to about 900–1200° F., preferably 900–110° F., especially about 1100° F., for example at a rate of about 12–18° F. per second for 1½-inch-thick plates, then air-cooled to ambient temperature (interrupted accelerated cooling—IAC). In this manner, there can be produced long sections, up to 90 feet or more, wherein the steel has a minimum yield strength of 70–75 ksi and a low yield/tensile strength ratio, e.g. less than 0.8–0.9 (80–90%), preferably less than 80%, without further heat treatment.

When so processed the Table I steels have a fine grain dual microstructure comprising primarily acicular ferrite and bainite (possibly with some minor amounts of martensite), and are essentially free of pearlite and blocky proeutectoid ferrite.

DESCRIPTION OF PREFERRED EMBODIMENTS

Figure 1:
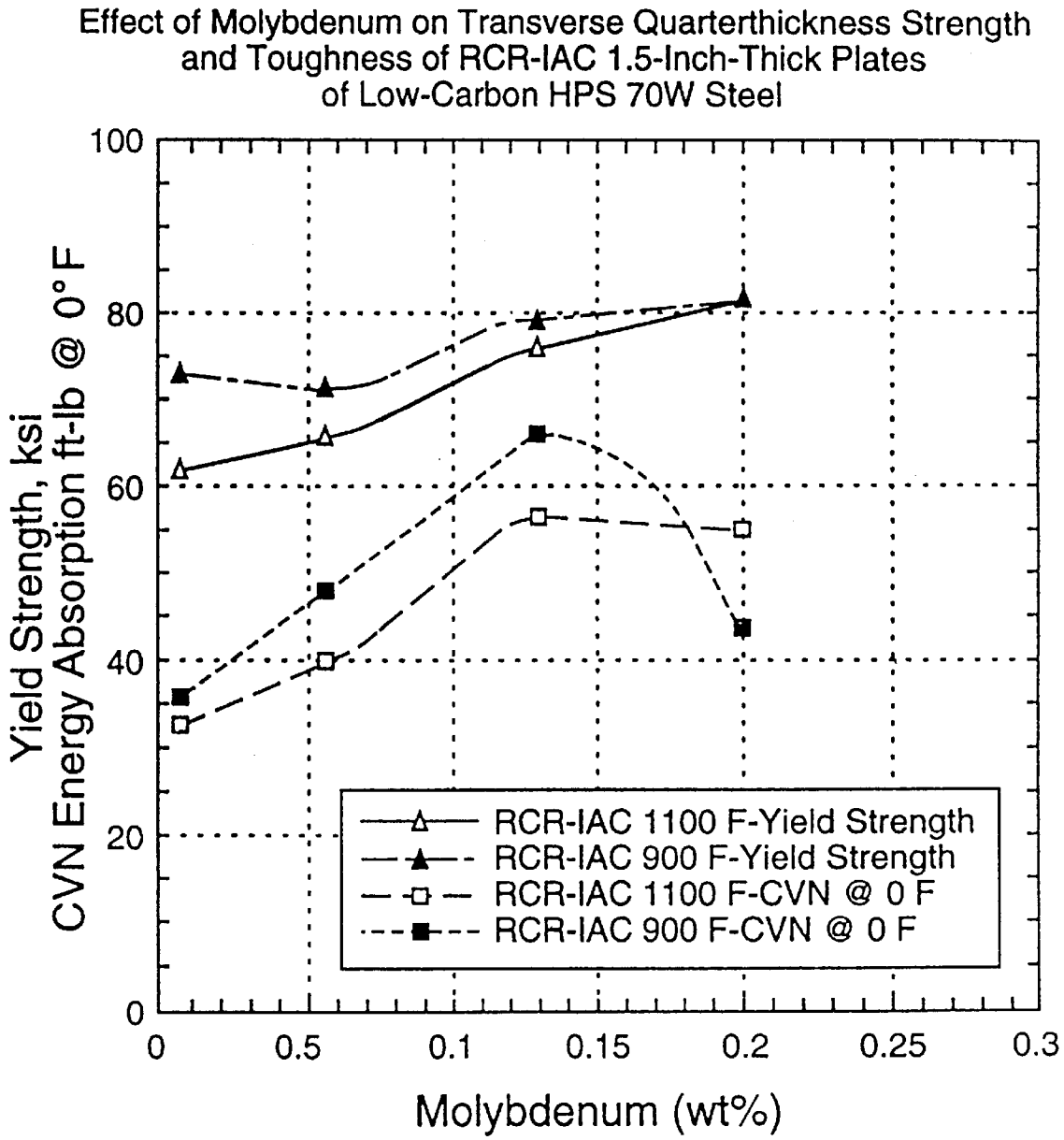
FIG. 1 is a graph showing the variation of yield strength and toughness (Charpy V-Notch test) versus molybdenum content in ASTM A709 Grade 70W-type steel.

Six five-hundred pound laboratory heats of the following steel compositions were made according to Table II:

TABLE II

| Heat | Composition, Weight Percent | | | | | | | | | | | | | |
|---|---|---|---|---|---|---|---|---|---|---|---|---|---|---|
| No. | C | Mn | P | S | Si | Cu | Ni | Cr | Mo | V | Cb | Ti | Al | N |
| 8016 | 0.090 | 1.20 | 0.019 | 0.007 | 0.44 | 0.29 | 0.25 | 0.60 | 0.007 | 0.031 | 0.021 | — | 0.027 | 0.005 |
| 8021 | 0.094 | 1.19 | 0.018 | 0.007 | 0.43 | 0.27 | 0.26 | 0.60 | 0.008 | 0.088 | — | 0.016 | 0.027 | 0.010 |
| 8061 | 0.090 | 1.20 | 0.014 | 0.005 | 0.46 | 0.30 | 0.25 | 0.60 | 0.008 | 0.072 | — | — | 0.027 | 0.006 |
| 8010 | 0.091 | 1.19 | 0.013 | 0.004 | 0.44 | 0.30 | 0.24 | 0.59 | 0.057 | 0.066 | — | — | 0.025 | 0.005 |
| 8011 | 0.096 | 1.21 | 0.015 | 0.004 | 0.43 | 0.29 | 0.26 | 0.61 | 0.130 | 0.060 | — | — | 0.026 | 0.005 |
| 8062 | 0.091 | 1.20 | 0.015 | 0.005 | 0.44 | 0.30 | 0.25 | 0.60 | 0.200 | 0.070 | — | — | 0.029 | 0.006 |

Ingots of the steels of Table II were soaked at 2150° F. All steels then were rolled to 1.5 inch thickness. One plate of steel 8016 was hot rolled to final thickness and finished at about 1950° F., then air cooled. Three other plates were conventionally control rolled (CCR) to 2.5 times the final thickness, air-cooled to about 1600° F., then rolled to the final thickness, finishing at about 1500° F. One of these plates was then air cooled; the other two were interrupted-accelerated cooled, one to 900° F., the other to 1100° F. Three plates of steel 8021 were rolled to 2.5 times final thickness, air-cooled to 1800° F., then recrystallize controlled-rolled to final thickness with a finishing temperature of about 1725° F. One plate was then air cooled and the other two plates were interrupted-accelerated cooled, one to 900° F., the other to 1100° F. Two plates of each of heat nos. 8010 and 8011 were rolled to 2.5 times the final thickness, air-cooled to 1800° F., then recrystallize controlled-rolled to final thickness, finishing at about 1725° F., then interrupted-accelerated cooled, two plates to 1100° F. and two to 900° F. Two plates of each of heat nos. 8061 and 8062 were rolled to 2.5 times the final thickness, air-cooled to 1800° F., then recrystallize controlled-rolled to final thickness, finishing at about 1725° F., then interrupted-accelerated cooled, two plates to 1100° F. and two to 900° F.

Properties of these steels are given in the following tables, showing the effect of interrupted-accelerated cooling (IAC) on the transverse quarter-thickness strength and toughness properties of 1.5 inch thick, low-carbon COR-TEN B plate with varying contents of molybdenum and vanadium.

TABLE III

| Heat No. 8016 (0.007% Mo; 0.031% V; 0.021% Cb) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Hot rolled | 77.1 | 92.3 | 0.84 | 30[15] | 50[30] | 105[100] | 11.5 |
| Controlled-Rolled (CCR) | 81.5 | 94.5 | 0.87 | 28[22] | 45[40] | 80[100] | 12.5 |
| Conventional Controlled-Rolled and Interrupted-Accelerated Cooled[3] | | | | | | | |
| IAC to 1100° F. | 65.8 | 97.4 | 0.68 | 8[5] | 17[20] | 28[60] | 10.0 |
| IAC to 900° F. | 70.4 | 112.0 | 0.63 | 21[20] | 29[45] | 49[100] | 10.5 |
| Conventional Controlled-Rolled, Interrupted-Accelerated Cooled[3] and Tempered (1175° F.) | | | | | | | |
| IAC to 1100° F. | 74.2 | 92.4 | 0.80 | 9[10] | 22[40] | 64[95] | 11.0 |
| IAC to 900° F. | 84.8 | 100.4 | 0.84 | 21[60] | 39[85] | 49[100] | 10.5 |

[1]Average results.
[2]0.2% offset.
[3]Water-spray-cooled to a midthickness temperature and air-cooled.

TABLE IV

| Heat No. 8021 (0.008% Mo; 0.088% V; 0.016% Ti) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Hot rolled | 82.3 | 97.0 | 0.85 | 26[10] | 42[25) | 81[70] | 11.5 |
| Controlled- | 85.4 | 100.2 | 0.85 | 24[10] | 38[20] | 73[60] | 11.5 |

TABLE IV-continued

| Heat No. 8021 (0.008% Mo; 0.088% V; 0.016% Ti) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Rolled (CCR) | | | | | | | |
| Recrystallize-Controlled-Rolled and Interrupted-Accelerated Cooled[3] | | | | | | | |
| IAC to 1100° F. | 61.4 | 96.3 | 0.64 | 24[10] | 33[10] | 72[62] | 10.5 |
| IAC to 900° F. | 73.1 | 105.1 | 0.70 | 23[7] | 36[10] | 70[55] | 10.5 |
| Recrystallize-Controlled-Rolled, Interrupted-Accelerated Cooled[3] and Tempered (1175° F.) | | | | | | | |
| IAC to 1100° F. | 78.1 | 96.0 | 0.81 | 11[5] | 21[10] | 53[50] | 10.5 |
| IAC to 900° F. | 83.5 | 99.2 | 0.84 | 11[5] | 22[10] | 54[45] | 10.5 |

[1]Average results.
[2]0.2% offset.
[3]Water-spray-cooled to a midthickness temperature and air-cooled.

TABLE V

| Heat No. 8010 (0.057% Mo; 0.066% V) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Controlled-Rolled (RCR) | 85.4 | 100.3 | 0.85 | 28[10] | 50[15] | 95[47] | 10.5 |
| Recrystallize-Controlled-Rolled and Interrupted-Accelerated Cooled[3] | | | | | | | |
| IAC to 1100° F. | 65.4 | 99.6 | 0.66 | 40[12] | 40[10] | 60[30] | 10.5 |
| IAC to 900° F. | 71.3 | 102.8 | 0.69 | 40[10] | 48[15] | 91[47] | 11.5 |
| Recrystallize-Controlled-Rolled, Interrupted-Accelerated Cooled[3] and Tempered (1175° F.) | | | | | | | |
| IAC to 1100° F. | 77.5 | 95.6 | 0.81 | 55[25] | 50[15] | 64[30] | 10.5 |
| IAC to 900° F. | 84.3 | 100.7 | 0.84 | 30[10] | 41[12] | 73[50] | 11.0 |

[1]Average results
[2]0.2% offset
[3]Water-spray-cooled to a midthickness temperature and air-cooled

TABLE VI

| Heat No. 8011 (0.13% Mo; 0.060% V) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Controlled-Rolled (RCR) | 88.1 | 102.7 | 0.86 | 33[10] | 54[13] | 88[45] | 11.0 |
| Recrystallize-Controlled-Rolled and Interrupted-Accelerated Cooled[3] | | | | | | | |
| IAC to 1100° F. | 76.4 | 104.0 | 0.73 | 32[6] | 56[17] | 109[55] | 11.5 |
| IAC to 900° F. | 79.5 | 105.8 | 0.75 | 25[5] | 66[20] | 104[55] | 11.5 |

TABLE VI-continued

| Heat No. 8011 (0.13% Mo; 0.060% V) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Recrystallize-Controlled-Rolled, Interrupted-Accelerated Cooled[3] and Tempered (1175° F.) | | | | | | | |
| IAC to 1100° F. | 84.4 | 102.0 | 0.83 | 50[15] | 59[17] | 72[31] | 10.5 |
| IAC to 900° F. | 88.8 | 105.8 | 0.84 | 34[6] | 54[15] | 64[35] | 11.0 |

[1]Average results
[2]0.2% offset
[3]Water-spray-cooled to a midthickness temperature and air-cooled

TABLE VII

| Heat No. 8061 (0.008% Mo; 0.072% V) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Controlled-Rolled (RCR) | 76.5 | 91.6 | 0.83 | 59[17] | 77[30] | 107[75] | 9.5 |
| Recrystallize-Controlled-Rolled and Interrupted-Accelerated Cooled[3] | | | | | | | |
| IAC to 1100° F. | 66.5 | 97.9 | 0.68 | 28[12] | 42[25] | 77[60] | 9.5 |
| IAC to 900° F. | 76.6 | 102.2 | 0.75 | 22[10] | 44[27] | 81[65] | 10.0 |

TABLE VIII

| Heat No. 8062 (0.20% Mo; 0.070% V) | | | | | | | |
|---|---|---|---|---|---|---|---|
| | Tensile[1] | | | Charpy V-Notch Impact[1] | | | Micro- |
| | Yield Strength, | Tensile Strength, | Yield/ Tensile | Energy, ft-lb [% Shear] | | | structure Grain Size |
| Condition | ksi[2] | ksi | Ratio | −40° F. | 0° F. | +72° F. | (ASTM No.) |
| Reheat-Quench and Tempered (1175° F.) | | | | | | | |
| Controlled-Rolled (RCR) | 90.8 | 103.7 | 0.87 | 66[20] | 75[27] | 88[57] | 11.0 |
| Recrystallize-Controlled-Rolled and Interrupted-Accelerated Cooled[3] | | | | | | | |
| IAC to 1100° F. | 81.3 | 109.8 | 0.74 | 38[20] | 55[35] | 89[67] | 11.5 |
| IAC to 900° F. | 81.3 | 117.5 | 0.69 | 35[18] | 44[30] | 94[70] | 12.0 |

[1]Average results
[2]0.2% offset
[3]Water-spray-cooled to a midthickness temperature and air-cooled From Table III, directed to the 0.007% Mo, 0.031% V, 0.021% Cb steel, it can be seen that high yield strength, above 75 ksi, and low yield/tensile ratio were obtained in the quenched and tempered steels, with both rolling practices. However, the conventional controlled-rolled and IAC steels reached only 65.8 ksi yield strength when cooled to 1100° F., and 70.4 when cooled to 900° F. Tempering after the latter rolling practices increased the yield strength to 74.2 ksi at a cooling-stop temperature of 1100° F. and 84.8 ksi at a cooling-stop temperature of 900° F.

Similar results for the quench and tempered processing are shown in Table IV for the 0.008% Mo, 0.088% V, 0.016 Ti steel. RCR/IAC processing gave a yield strength of only 61.4 ksi on cooling to 1100° F., and 73.1 ksi on cooling to 900° F. Tempering such processed steel raised the yield strength to 78.1 ksi on cooling to 1100° F. and 83.5 ksi on cooling to 900° F.

Similar results were obtained with the 0.057% Mo, 0.066% V steel, as shown in Table V.

As shown in Table VII, RCR/IAC processing of the 0.008% Mo, 0.072% V steel, gave an acceptably high yield strength (76.6 ksi) upon cooling to 900° F., but only 66.5 ksi when the steel was cooled to 1100° F.

From Tables VI and VIII, setting forth the properties of steel heat Nos. 8011 and 8062, containing, respectively, 0.13% and 0.20% Mo, it is seen that these steels, when processed by the RCR/IAC procedure, without further heat treatment, each showed a minimum yield strength of greater than 75 ksi when IAC cooled to either 1100° F. or 900° F., and each had a low yield-to-tensile strength ratio, i.e. 0.75 or less. In each such case, the steel exhibited high impact strength, CVN, ft. -lbs. In contrast, steels 8021 and 8061, each containing 0.008% Mo, when similarly processed, showed a lower yield strength: steel 8021 having 61.4 ksi yield strength when cooled to 1100° F. and 73.1 ksi when cooled to 900° F., and steel 8061 showing a yield strength of only 66.5 ksi when cooled to 1100° F., although when cooled to 900° F. it had a yield strength of 76.6 ksi. In case of each of the latter steels, the steel showed a lower impact strength than the higher Mo steels. Similarly, steel 8010, containing 0.057% Mo, when similarly processed, showed a yield strength of 65.4 ksi when cooled to 1100° F. and 71.3 when cooled to 900° F., and it, too, had lower impact strength.

Although steels 8016, 8021 and 8010, when processed by RCR/IAC and tempered, gave high yield strength and low yield/tensile ratio, conventional tempering is not practical for long products, e.g. of 90–120 feet length, such as bridge girders, since existing tempering facilities will not accommodate such great lengths and, additionally such further step, were suitable facilities installed, would add to the overall manufacturing cost.

The effect of Mo content on yield strength and impact strength of these steels, containing at least about 0.06 wt. % V, is shown graphically in FIG. 1, from which it is seen that at least about 0.08–0.10 wt. % Mo is required to assure a minimum yield strength of 70 ksi when the steel is IAC cooled to 900° F. and about 0.12% Mo is required to assure a minimum yield strength of 70 ksi when the steel is IAC cooled to 1100° F. Also, at about 0.08% Mo, the CVN impact strength resulting from both 900 and 1100° F. cooling begins sharp increases which continue and approach each other at about 0.13% Mo, after which point, the CVN begins to decrease, the 900 and 1100° F. cooling curves for CVN impact strength becoming equal at about 0.18% Mo, at which point the yield strength has become essentially constant at about 80 ksi for both the 900 and the 1100° F. cooling curves. Accordingly, Mo is limited to about 0.08% to about 0.35%, preferably to about 0.13% to about 0.30%, and especially about 0.15% to about 0.25%.

Phosphorous is present in the steels of the invention to add to weatherability of the steel.

Nitrogen is needed when vanadium is added—for vanadium nitride precipitation; nitrogen also is needed when titanium is added—for austenite grain refinement with titanium nitrides.

In order to further develop the composition and processing parameters of the inventive steel, four additional laboratory heats of steel, containing about 0.17% Mo, but with modifications in Cr and Cb contents, were made and evaluated.

The compositions of these additional steels, numbers 8068, 8057, 8058 and 8059, are shown in Table IX.

TABLE IX

Chemical Composition of Experimental Laboratory Heats -- Percent

| Heat No. | C | Mn | P | S | Si | Cu | Ni | Cr | Mo | V | Cb | Ti | Al | N |
|---|---|---|---|---|---|---|---|---|---|---|---|---|---|---|
| 9705-8068 | 0.089 | 1.23 | 0.014 | 0.004 | 0.42 | 0.34 | 0.32 | 0.60 | 0.17 | 0.066 | | | 0.022 | 0.006 |
| 9705-8057 | 0.091 | 1.21 | 0.013 | 0.004 | 0.42 | 0.34 | 0.31 | 0.60 | 0.16 | 0.065 | 0.013 | | 0.026 | 0.005 |
| 9705-8058 | 0.092 | 1.21 | 0.015 | 0.004 | 0.41 | 0.34 | 0.31 | 0.35 | 0.17 | 0.068 | 0.014 | | 0.026 | 0.005 |
| 9705-8059 | 0.090 | 1.21 | 0.012 | 0.004 | 0.43 | 0.32 | 0.32 | 0.35 | 0.17 | 0.070 | 0.025 | | 0.026 | 0.005 |

Steel 8068 was the base composition, with a chromium content of 0.60% and a molybdenum content of 0.17%. Steel 8057 was similar to base steel 8068, except that a small amount of columbium (niobium) (0.013%) was added. Steel 8058 was similar to the low-Cb steel 8057, except that the Cr content was lowered from 0.60 to 0.35%. Steel 8059 was similar to the 0.35% Cr steel 8058, except that the Cb content was increased from 0.014% to 0.025%.

Table X sets forth the basic rolling and cooling process parameters used to produce plates of the Table IX steels.

TABLE X

Process Overview for Rolling and Cooling of Experimental Laboratory Steels

| Heat No. | Soaking Temperature (° F.) | Rolling Practice | Final Thickness (inch) | FRT† (° F.) | Cooling Practice |
|---|---|---|---|---|---|
| 9705-8057<br>9705-8058<br>9705-8059 | 2150 | Controlled-Rolled 2.5T-1600° F.-Release | 1.5 | 1500 | Interrupted-Accelerated Cooled to |
| 9705-8068<br>9705-8057<br>9705-8058<br>9705-8059 | 2150 | Controlled-Rolled 2.5T-1600° F.-Release | 2.0 | 1500 | Interrupted-Accelerated Cooled to 1100° F. |
| 9705-8068 | 2150 | Recrystallize Controlled-Rolled 2.5T-1800° F.-Release | 1.5 | 1725 | Interrupted-Accelerated Cooled to 1100° F. |

FRT = Finish rolling temperature.
†= Plate midthickness temperature.

More specifically, four 500 pound vacuum-induction heats of the Table IX steels were melted and cast into 7×11½×23 inch big end down, hot top ingots. Each ingot was sectioned into pieces. All pieces were reheated to (soaked at) 2150° F., then three pieces of each steel were controlled-rolled with a 2.5 T practice as indicated in Table X. A 1.5 inch thick plate of the base steel (steel 8068) was the only steel to be given an RCR processing, with a finish rolling temperature of about 1725° F. (measured by a midthickness thermocouple), because this steel does not contain Cb. The 1.5 inch thick plates from the other heats (steel nos. 8057, 8058 and 8059) were given a conventional controlled-rolling, with a finish rolling temperature of about 1500° F. In addition, one piece from each heat was conventionally controlled-rolled to 2 inch thick plate with a finish rolling temperature of about 1500° F. The 1.5 and 2.0 inch thick plates, immediately after being controlled-rolled, were given an IAC treatment through water curtains to about 1100° F., then removed from the water curtains and air-cooled to room temperature (Table X). Finally, one 1.5 inch thick plate of each steel was air-cooled to room temperature after controlled-rolling, then reheated to 1650° F. for 1 hour and 15 minutes, water-quenched, tempered at 1175° F. for 1 hour and 15 minutes, and air-cooled. Plate specimens in both the as-rolled IAC and as-rolled heat-treated conditions then were evaluated for mechanical properties and microstructure.

Transverse 0.505 inch diameter tension test specimens and transverse Charpy V-notch (CVN) impact test specimens, notched in the through-thickness direction, were obtained from the quarter-thickness location of each plate sample. The tensile properties were determined with duplicate specimens, and a minimum of 2 CVN impact specimens were tested at −40° F., −10° F. and 0° F. Energy absorption and percent shear fracture appearance impact data were tabulated.

Tables XI–XIV give the results of mechanical testing of the 1.5 and 2 inch thick plates of the Table IX steels produced in accordance with the Table X processing parameters as amplified above.

TABLE XI

Effect of Interrupted Accelerated Cooling (IAC) on the Transverse Quarter-Thickness Strength and Toughness Properties of COR-TEN B Steel Plates (Steel 8068/High Cr—No Cb) (Composition: 0.089C-1.23Mn-0.014P-0.004S-0.42Si-0.34 Cu-0.32Ni-0.60Cr-0.17Mo-0.066V-0.022Al-0.006N)

| | Tensile[1] | | | | | Charpy-V-Notch Impact Energy ft-lb [% Shear] | | |
|---|---|---|---|---|---|---|---|---|
| Condition | YS[2] (ksi) | TS (ksi) | YS/TS Ratio | Elongation (%) | Red. in Area (%) | −40° F. | −10° F. | 0° F. |
| Recrystallize Controlled-Rolled and Reheat-Quench and Tempered (1175°) | | | | | | | | |
| 1.5 inch thick | 83.3 | 97.3 | 0.86 | 22.8 | 67.7 | 38[10] | 45[10] | 54[20] |
| Recrystallize Controlled-Rolled and Interrupted-Accelerated-Cooled[3,5] | | | | | | | | |
| 1.5 inch thick | 72.2 | 110.6 | 0.65 | 21.3 | 60.2 | 13[5] | 23[12] | 26[10] |
| Conventional Controlled-Rolled, Interrupted-Accelerated-Cooled[4,5] | | | | | | | | |
| 2.0 inch thick | 64.0 | 106.9 | 0.60 | 23.5 | 55.5 | 9[5] | 19[10] | 17[17] |

[1]Average results for duplicate tests.
[2]0.2 percent offset.
[3]Finish rolling temperature of 1725° F.
[4]Finish rolling temperature of 1500° F.
[5]Water-spray-cooled to a midthickness temperature of 1100° F. and air-cooled.

TABLE XII

Effect of Interrupted Accelerated Cooling (IAC) on the Transverse Quarter-Thickness Strength and Toughness Properties of COR-TEN B Steel Plates (Steel 8057/High Cr-Low Cb) (Composition: 0.091C-1.21Mn-0.013P-0004S-0.042Si-0.34Cu-0.31Ni-0.60 Cr-0.16Mo-0.065V-0.013Cb-0.026Al-0.005N)

| | Tensile[1] | | | | | Charpy-V-Notch Impact Energy ft-lb [% Shear] | | |
|---|---|---|---|---|---|---|---|---|
| Condition | YS[2] (ksi) | TS (ksi) | YS/TS Ratio | Elongation (%) | Red. in Area (%) | −40° F. | −10° F. | 0° F. |
| Conventional Controlled-Rolled and Reheat-Quench and Tempered (1175° F.) | | | | | | | | |
| 1.5 inch thick | 88.7 | 110.3 | 0.80 | 22.2 | 66.1 | 52[10] | 62[27] | 65[35] |
| Conventional Controlled-Rolled and Interrupted-Accelerated-Cooled[3,4] | | | | | | | | |
| 1.5 inch thick | 72.3 | 114.5 | 0.63 | 19.3 | 53.0 | 18[10] | 33[12] | 33[12] |
| Conventional Controlled-Rolled and Interrupted-Accelerated-Cooled[3,4] | | | | | | | | |
| 2.0 inch thick | 64.8 | 110.3 | 0.59 | 20.9 | 51.8 | 8[5] | 18[10] | 28[10] |

[1]Average results of duplicate tests.
[2]0.2 percent offset.
[3]Finish rolling temperature of 1500° F.
[4]Water-spray-coo1ed to a midthickness temperature of 1100° F. and air-cooled.

TABLE XIII

Effect of Interrupted Accelerated Cooling (IAC) on the Transverse Quarter-Thickness Strength and Toughness Properties of COR-TEN B Steel Plates (Steel 8058/Low Cr-Low Cb) (Composition: 0.092C-1.21Mn-0.015P-0.004S-0.41Si-0.34 Cu-0.31Ni-0.34Cr-0.17Mo-0.068V-0.014Cb-0.026Al-0.005N)

| | Tensile[1] | | | | | Charpy-V-Notch Impact Energy ft-lb [% Shear] | | |
|---|---|---|---|---|---|---|---|---|
| Condition | YS[2] (ksi) | TS (ksi) | YS/TS Ratio | Elongation (%) | Red. in Area (%) | −40° F. | −10° F. | 0° F. |
| Conventional Controlled-Rolled and Reheat-Quench and Tempered (1175° F.) | | | | | | | | |
| 1.5 inch thick | 81.4 | 95.6 | 0.85 | 25.8 | 68.0 | 35[15] | 59[30] | 73[37] |
| Conventional Controlled-Rolled and Interrupted-Accelerated-Cooled[3,4] | | | | | | | | |
| 1.5 inch thick | 71.4 | 106.0 | 0.67 | 22.9 | 58.6 | 24[10] | 47[10] | 46[10] |
| Conventional Controlled-Rolled and Interrupted-Accelerated-Cooled[3,4] | | | | | | | | |
| 2.0 inch thick | 65.6 | 104.4 | 0.63 | 21.5 | 58.2 | 7[5] | 11[5] | 17[10] |

[1]Average results of duplicate tests.
[2]0.2 percent offset.
[3]Finish rolling temperature of 1500° F.
[4]Water-spray-cooled to a midthickness temperature of 1100° F. and air-cooled.

TABLE XIV

Effect of Interrupted Accelerated Cooling (IAC) on the Transverse Quarter-Thickness Strength and Toughness Properties of COR-TEN B Steel Plates (Steel 8059/Low Cr-High Cb) (Composition: 0.090C-1.21Mn-0.012P-0.004S-0.43Si-0.32Cu-0.32Ni-0.35Cr-0.17 Mo-0.070V-0.025Cb-0.026Al-0.005N)

| | Tensile[1] | | | | | Charpy-V-Notch Impact Energy ft-lb [% Shear] | | |
|---|---|---|---|---|---|---|---|---|
| Condition | YS[2] (ksi) | TS (ksi) | YS/TS Ratio | Elongation (%) | Red. in Area (%) | −40° F. | −10° F. | 0° F. |
| Conventional Controlled-Rolled and Reheat-Quench and Tempered (1175° F.) | | | | | | | | |
| 1.5 inch thick | 86.8 | 99.8 | 0.87 | 21.4 | 68.1 | 68[35] | 81[57] | 85[65] |
| Conventional Controlled-Rolled and Interrupted-Accelerated-Cooled[3,4] | | | | | | | | |
| 1.5 inch thick | 74.5 | 100.9 | 0.74 | 23.0 | 65.7 | 43[10] | 76[25] | 113[55] |
| Conventional Controlled-Rolled and Interrupted-Accelerated-Cooled[3,4] | | | | | | | | |
| 2.0 inch thick | 61.5 | 104.2 | 0.59 | 22.4 | 50.7 | 10[5] | 14[5] | 22[10] |

[1]Average results of duplicate tests.
[2]0.2 percent offset.
[3]Finish rolling temperature of 1500° F.
[4]Water-spray-cooled to a midthickness temperature of 1100° F. and air-cooled.

From Table XI, it will be noted that only the 1.5 inch thick specimen of the high (0.60%) Cr/no Cb steel 8068, when subjected to the RCR-IAC processing of this invention, met the minimum yield strength requirement of 70 ksi and the maximum yield strength/tensile strength ratio of 0.85.

In Table XII, where the test steel 8057 was a high (0.60%) Cr/low (0.013%)Cb steel which was conventionally controlled rolled (CCR) before further heat treatment, it is seen that only the 1.5 inch thick specimen, thus controlled rolled and then subjected to IAC heat treatment, met the aforesaid minimum and maximum standards of yield strength and YS/TS ratio.

In Table XIII, where the test steel 8058 was a low (0.34%) Cr/low (0.014%) Cb steel, again only the CCR and IAC-treated 1.5 inch thick specimen met the YS and YS/TS ratio criteria, although the quenched and tempered specimen was close in these mechanical properties. In this invention, as above noted, such latter treatment is to be avoided for long lengths of steel products.

In Table XIV, where the test steel 8059 was a low (0.35%) Cr/high (0.025%) Cb steel, again only the 1.5 inch thick specimen, conventionally controlled rolled (CCR) and IAC-treated, met these same criteria.

As regards the controlled-rolled, air-cooled, quenched and tempered steels of Tables XI–XIV, the yield strengths of the 1.5 inch thick plates of the four test steels in this processed condition ranged from 81.4 ksi for the low Cr/low Cb steel 8058 to 88.7 ksi for the high Cr/low Cb steel 8057, indicating a moderately strong contribution of Cr to the yield strength, as well as to the tensile strength (110.3 ksi for the high Cr/low Cb steel 8057—the highest tensile strength of the four quenched and tempered specimens). The YS/TS ratios of the quenched and tempered 1.5 inch thick plates ranged from 0.80 for the high Cr/low Cb steel 8057 to 0.87 for the low Cr/high Cb steel 8059, thus establishing a strong effect of Cb in increasing yield strength in quenched and tempered (Q&T) ferrite-bainite steels that receive a controlled-rolling treatment before heat treatment. Such strengthening appears to be largely due to the presence of a higher amount of bainite in the columbium steels, as seen in photomicrographs of these steels.

The average CVN energy absorptions at −10° F. (the AASHTO Zone 3 test temperature for 70W steel plates) ranged from 45 ft-lbs for steel 8068 (the base steel) to 81 ft-lbs for the low Cr/High Cb steel 8059, thereby demonstrating the beneficial grain-refining effect of Cb on the toughness of Q&T ferrite-bainite steels that received a controlled-rolling treatment, as shown in Table X, before heat treatment.

As regards the CCR-IAC processing, the base steel 8068 (high Cr/no Cb) in this condition exhibited a yield strength of 72.2 ksi, which is less than the yield strength of steel 8016 of Table III when treated with IAC to 1100° F., but about the same as the latter steel when treated with IAC to 900° F. This illustrates that the lower temperature provides somewhat higher strength, but for commercial production, IAC cooling to about 1100° F. is preferred over lower temperatures because, at such higher temperature, as compared, e.g. to a temperature of 900–1050° F., the steel is easier to flatten and level. Moreover, at temperatures lower than about 900° F., the steel tends to form more bainite, tending toward a decrease of impact properties. At cooling-stop temperatures above about 1200° F., e.g. about 1300° F., the needed fine grain structure is not obtained, with accompanying decrease of strength properties.

As above indicated, the CCR-IAC processed 1.5 inch thick plates of Tables XII–XIV exhibited yield strengths of 71.4 ksi (low Cr/low Cb steel 8058) to 74.5 ksi (low Cr/high Cb steel 8059), indicating that all four steels met, but barely, the 70 ksi minimum yield strength requirement. The YS/TS ratios of these steels ranged from 0.63 to 0.74, thus meeting the maximum requirement of 0.85; the highest value being exhibited by steel 8059—the low Cr/high Cb. steel.

These 1.5 inch thick specimens of CCR-IAC processed plates exhibited CVN energy absorptions at −10° F. of 23 ft-lbs (high Cr base steel 8068) (which does not meet the 30 ft-lbs minimum AASHTO requirement); 33 ft-lbs (high Cr/low Cb steel 8057); 47 ft-lbs (low Cr/low Cb steel 8058), and 76 ft-lbs (low Cr/high Cb steel 8059). Thus the 0.35% chromium, 0.025% columbium steel was the best 1.5 inch thick plate steel overall in the IAC-processed condition.

None of the controlled rolled and IAC processed 2 inch thick plates of the last four test steels exhibited minimum yield strengths of 70 ksi or CVN energy absorptions at −10° F. close to the required 30 ft-lbs. Also the YS/TS ratios were very low—from 0.59 to 0.63, indicating continuous-yielding (roundhouse) tensile stress-strain curves.

Accordingly, to further develop the above-described low-carbon, low-sulfur, modified A852 (70W) steels, two still further laboratory-sized heats were made, containing about 0.27% Mo and 0.34 or 0.35% Cr, but with modifications in vanadium and columbium contents. The heats were cast and then either conventional controlled-rolled (CCR) or recrystallize control rolled (RCR) to 2 inch thick plates, then subjected to interrupted accelerated cooling (IAC) processing, and evaluated for mechanical properties—all as shown in Tables XV and XVI.

TABLE XV

Transverse Quarter-Thickness Mechanical Properties of Controlled-Rolled and Interrupted Accelerated Cooled (IAC) COR-TEN B Steel Plates (Steel 8043/V High Mo) (Composition: 0.09C-1.2Mn-0.014P-0.004S-0.45Si-0.31Cu-0.26Ni-0.35 Cr-0.27Mo-0.09V-0.01Ti-0.032Al-0.011N)

| | Tensile[1] | | | | | Charpy-V-Notch Impact Energy | | |
|---|---|---|---|---|---|---|---|---|
| | YS[2] | TS | YS/TS | Elong- | Red. in | ft-lb [% Shear] | | |
| Condition | (ksi) | (ksi) | Ratio | ation (%) | Area (%) | −10° F. | 0° F. | 32° F. |
| Recrystallize Controlled-Rolled and Interrupted-Accelerated-Cooled[3,4] | | | | | | | | |
| 2.0 inch thick | 74.5 | 96.9 | 0.77 | 28.0 | 72.4 | 125[65] | 130[62] | 151[75] |

[1]Average results of duplicate tests.

[2]0.2% offset.

[3]Finish rolling temperature of 1725° F.

[4]Water-spray-cooled to a midthickness temperature of 1100° F. and air-cooled.

TABLE XVI

Transverse Quarter-Thickness Mechanical Properties of Controlled-Rolled and Interrupted Accelerated Cooled (IAC COR-TEN B Steel Plates (Steel 8044/Cb High Mo) (Composition: 0.09C-1.2Mn-0.014P-0.004S-0.42Si-0.30Cu-0.25 Ni-0.34Cr-0.27Mo-0.037Cb-0.032Al-0.005N)

| | Tensile[1] | | | | | Charpy-V-Notch Impact Energy ft-lb [% Shear] | | |
|---|---|---|---|---|---|---|---|---|
| Condition | YS[2] (ksi) | TS (ksi) | YS/TS Ratio | Elong-ation (%) | Red. in Area (%) | −10° F. | 0° F. | 32° F. |
| Conventiona1 Controlled-Rolled and Interrupted-Accelerated-Cooled[3,4] | | | | | | | | |
| 2.0 inch thick | 78.5 | 100.5 | 0.78 | 25.9 | 71.3 | 119[62] | 123[57] | 162[82] |

[1]Average results of duplicate tests.
[2]0.2% offset.
[3]Finish rolling temperature of 1500° F.
[4]Water-spray-cooled to a midthickness temperature of 1100° F. and air-cooled.

The CCR-IAC steel 8044 (Table XVI), containing 0.35% Cr and 0.037% Cb, exhibited the best combination of yield strength (78.5 ksi) and CVN impact energy absorption at −10° F. (119 ft-lbs) and, therefore is useful for at least 2 inch thick 70W-type steel plates too long to be heat-treated as by tempering or quenching and tempering (Q&T). The addition of cb to this steel contributed to grain refinement, and Mo increased hardenability, resulting in less ferrite and more bainite, as determined by photomicrographic studies.

The lower Cr content of the Table XV and XVI steels, i.e. about 0.35% Cr versus the 0.50 to 0.60 Cr in the Table II steels (and in the prior art HPS 70 W bridge steel), would tend to lower the resistance of the Table XV and XVI steels to atmospheric corrosion, according to the ASTM G101 formula. However, the 0.27% Mo (preferred range of 0.13–0.30% Mo) included in these latter steels more than offsets this loss in weatherability. See The "LaQue formula" appearing in an article by F. L. LaQue in Proceedings of the ASTM, Vol. 51, 1951, pp. 494–582. The lower chromium content also may be of potential advantage in reducing the amount of carcinogenic hexavalent chromium that, by some, is thought to be exuded during welding.

Figure 2:
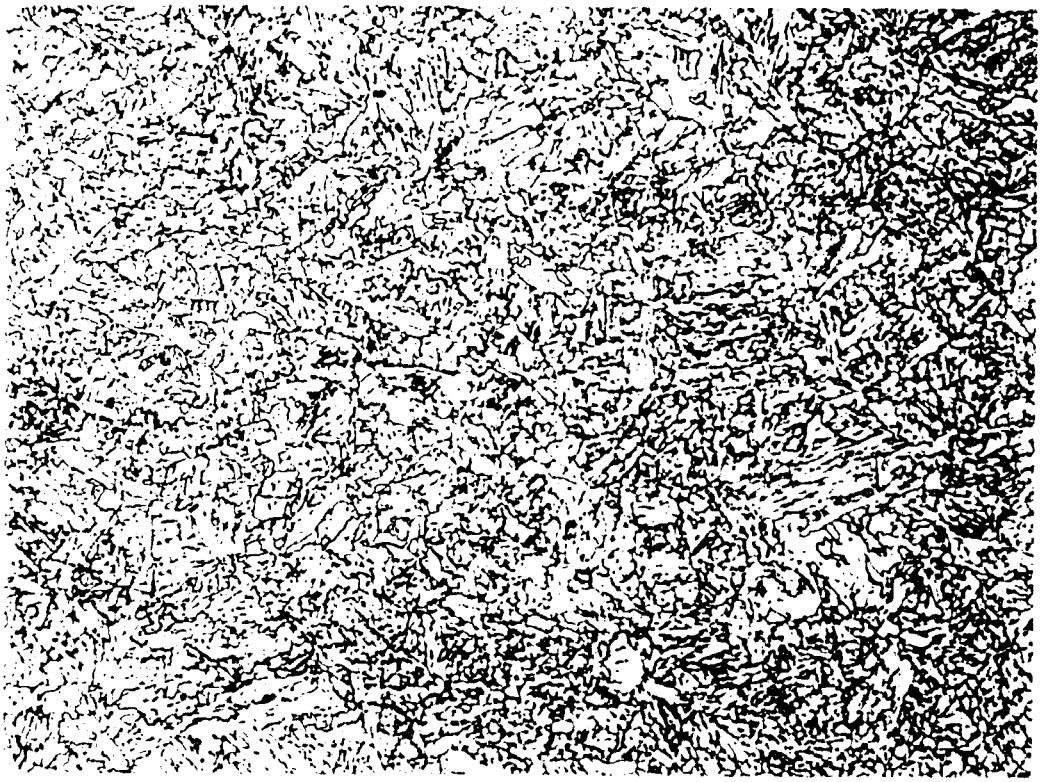
FIG. 2 is a photomicrograph showing the fine grain, largely acicular ferrite/bainite structure of the steels of the invention when processed by the RCR/IAC method.

It is seen from the data of Tables XV and XVI that both the V-and the Cb-bearing steels, in 2 inch thickness, met the desired properties of minimum yield strength, maximum YS/TS ratio, with good impact values. However, the Cb-bearing steel exhibited a better combination of strength and toughness The photomicrograph of FIG. 2 shows the essentially acicular ferrite and bainite fine grain microstructure of the steels processed in accordance with the invention. As above noted, the formation of bainite is promoted by the addition of Cb, and to a lesser extent by V, to the steels of the invention. On the other hand, increasing Mo content upwardly of about 0.3%, and especially above about 0.35 wt. %, results in the formation of excessive amounts of martensite with accompanying decrease of steel properties. Reference to Tables II and XV will show that a small amount of titanium, e.g. up to about 0.02,%, preferably up to about 0.01%, may be included in the steels of the invention, e.g. for added grain refinement. A small amount of nickel, e.g. up to about 0.5%, is useful for adding to hardenability and oxidation resistance.

The above steels, when processed by the CCR/IAC or RCR/IAC methods, as described, should possess good weldability, suiting them for constructional fabrication applications. The achievement of a uniform minimum yield strength of 70–75 ksi, together with low yield/tensile ratio, below 0.85, and high impact strength, above 30 Ft-lbs, without the need for further heat treatment, permits, for the first time, the production of long, e.g. up to 90 feet or greater, sections of steel products up to at least 2 to 2½ inches maximum thickness, such as plates, tubes, and fabricated shapes, for bridge, ship and other constructional applications.

With conventional quenching and tempering, the low-carbon, low-sulfur steels of the invention can be produced in section thicknesses up to about 4 inches and having high yield strength (at least 70 ksi) and relatively low yield/tensile ratio—useful in applications in which very long sections are not needed. Such steels should exhibit better weldability than the current, higher carbon A852 quenched and tempered steel.

What is claimed is:

1. A weathering constructional steel article, said steel article having been produced by a method comprising:

a) providing a steel composition consisting essentially of about

| Element | Weight Percent |
|---|---|
| carbon | 0.80–0.12 |
| manganese | 0.80–1.35 |
| silicon | 0.30–0.65 |
| molybdenum | 0.08–0.35 |
| vanadium | 0.06–0.14 |
| copper | 0.20–0.40 |
| nickel | up to 0.50 |
| chromium | 0.30–0.70 |
| columbium | up to about 0.04 |
| titanium | up to 0.02 |
| sulfur | up to 0.01 |
| phosphorus | up to about 0.02 |
| nitrogen | 0.001 to 0.014 |
| iron | balance, except for incidental steelmaking impurities, |

b) heating the steel to a hot rolling temperature;

c) hot rolling the steel to a thickness greater than the final desired thickness;

d) air-cooling, by holding the steel at the greater than desired thickness, to a temperature of about 1800–1850° F. (RCR) or 1600–1650° F. (CCR);

e) control rolling the steel to final thickness with finish rolling at a temperature of about 1700–1750° F. (RCR) or 1400–1500° F. (CCR);

f) water-cooling the steel to a temperature of about 900–1200° F., and g) air-cooling the steel to ambient temperature, without further heat treatment;

said steel article having a fine grain dual phase microstructure of acicular ferrite and bainite essentially free of pearlite and exhibiting a minimum yield strength of 70 ksi and a yield-to-tensile strength ratio less than about 0.85.

2. A steel article according to claim 1, wherein the maximum carbon content of the steel is about 0.10%.

3. A steel article according to claim 2, wherein the steel comprises molybdenum in an amount of about 0.13 to about 0.30 weight percent.

4. A steel article according to claim 3, wherein the steel comprises chromium in an amount of from about 0.35 to 0.60 weight percent.

5. A steel article according to claim 4, wherein the steel comprises titanium from a trace amount to about 0.01 weight percent.

6. A steel article according to claim 5, wherein the steel comprises vanadium from about 0.06 to about 0.10 weight percent.

7. A steel article according to claim 6, wherein the steel comprises sulfur in a maximum amount of about 0.005.

8. A steel article according to claim 6, wherein the minimum yield strength of the processed steel is about 75 ksi and the yield/tensile ratio is under about 0.8 when the rolled steel is water cooled to a temperature in the range of about 900–1200° F.

9. A steel article according to claim 11 wherein titanium is present from a trace amount to under about 0.02%.

10. A steel article according to claim 4, wherein the maximum amount of chromium is about 0.40 weight percent.

11. A steel article according to claim 9, wherein the steel contains columbium from an amount of about 0.01 to about 0.04 weight percent, and molybdenum in a minimum amount of about 0.25 weight percent.

12. A steel article according to one of claims 1–11, comprising initially heating the steel to a temperature of at least about 2150° F., hot rolling the steel to a thickness of about 2 to 2½ times the desired final thickness, recrystallize control or conventional control rolling the steel to final hot rolled thickness and, after rolling, water-cooling the steel, at a rate from about 10 to about 20° F. per second, to a temperature of about 1050–1150° F.

13. A steel article according to one of claims 1–11, comprising, in steps (d) and (e) of claim 1, the conventional control rolling and rolling to a finish rolling temperature of about 1500° F., interrupted-accelerated-cooling the steel to a midthickness temperature of about 1050° F. to 1150° F., then air-cooling the steel to ambient temperature.

14. A steel article according to one of claims 11, comprising excluding the steps of control rolling and interrupted accelerated cooling and further including the steps of hot rolling to final desired thickness and then quenching and tempering the article.

15. A steel article made in accordance with one of claims 1–11 wherein the steel has been initially heated to a temperature of at least about 2150° F. and, after recrystallize control rolling, has been water-cooled to a temperature of about 900–1150° F., then air-cooled to ambient temperature.

16. A steel article made in accordance with one of claims 1–11, wherein the article has a thickness of about 2½ inches maximum and a CVN impact energy absorption at −10° F. of 30 ft-lbs minimum.

17. A high performance constructional and weathering steel article, consisting essentially, in weight percent, of about: carbon 0.08–0.12%; manganese 0.80–1.35%; silicon 0.30–0.65%; molybdenum from about 0.25 to 0.35%; vanadium from a trace amount up to about 0.10%; copper 0.20–0.40%; nickel 0.50% max.; chromium 0.30–0.70%; columbiuim from about 0.01 to 0.04%; titanium up to 0.02%; sulfur up to 0.01%; phosphorous up to about 0.02%; nitrogen up to about 0.015%; aluminum up to about 0.035%; iron, balance except for incidental impurities; said steel article having been produced by heating the steel to a thickness about 2 to 3 times the final desired thickness, air-cooling the steel to a temperature of about 1800–1850° F. (RCR) or 1600–1650° F. (CCR), control rolling the steel to final thickness with finish rolling at a temperature of about 1700–1750° F. (RCR) or 1400–1500° F. (CCR), then water-cooling the steel to about 900–1200° F., then air-cooling the steel to ambient temperature without further heat treatment, said steel article having a maximum thickness of about 2½ inches and a fine grain dual phase microstructure of acicular ferrite and bainite essentially free of pearlite and exhibiting a minimum yield strength of 70 ksi and a yield-to-tensile strength ratio less than about 0.85.

18. A steel article according to claim 17, said steel article having a length of 90 feet or more.

19. A steel article according to claim 17, said steel article having a CVN impact energy absorption at −10° F. of 30 ft-lbs minimum.

* * * * *